US012082733B2

(12) United States Patent
Moss et al.

(10) Patent No.: US 12,082,733 B2
(45) Date of Patent: Sep. 10, 2024

(54) MOUNTING BRACKET

(71) Applicant: House of Atlas, LLC, Evanston, IL (US)

(72) Inventors: Jason Moss, Libertyville, IL (US); Matthew Berman, Chicago, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 17/951,709

(22) Filed: Sep. 23, 2022

(65) Prior Publication Data

US 2024/0108159 A1 Apr. 4, 2024

(51) Int. Cl.
*A47H 1/142* (2006.01)

(52) U.S. Cl.
CPC ..... *A47H 1/142* (2013.01)

(58) Field of Classification Search
CPC ..... A47H 1/142
USPC ..... 248/254, 262, 267, 475.1
See application file for complete search history.

(56) References Cited

U.S. PATENT DOCUMENTS

| | | | | |
|---|---|---|---|---|
| 241,991 | A | 5/1881 | Jones | |
| 331,850 | A | 12/1885 | Umstadter | |
| 446,675 | A | 2/1891 | Glidden | |
| 568,628 | A * | 9/1896 | Reubel | A47H 1/122 248/265 |
| 726,950 | A | 5/1903 | Larson | |
| 732,821 | A | 7/1903 | Bitner | |
| 762,594 | A | 6/1904 | Michaels | |
| 828,503 | A | 8/1906 | Powell | |
| 940,711 | A | 11/1909 | Eells | |
| 969,051 | A * | 8/1910 | Garraway | A47H 1/13 248/254 |
| 999,675 | A | 8/1911 | Schmitz | |
| 1,004,471 | A | 9/1911 | Rose | |

(Continued)

FOREIGN PATENT DOCUMENTS

FR 2898795 A3 * 9/2007 ..... A47H 1/022

OTHER PUBLICATIONS

Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.

(Continued)

*Primary Examiner* — Kimberly T Wood
(74) *Attorney, Agent, or Firm* — Fitch, Even, Tabin & Flannery LLP

(57) ABSTRACT

A bracket for attachment to a structure is provided that includes a base having a supporting portion and a mounting portion extending at an angle to the supporting portion. The mounting portion defines one or more first mounting holes sized to receive a fastener for mounting the bracket to the structure and disposed at an oblique angle to the mounting portion. The base defines a gap having a width. The bracket includes a support arm extending from the base and through the gap of the base. The support arm has a width at an interconnection with the base that is less than the width of the of the gap such that a first portion of the base is on one side of the support arm and a second portion of the base is on an opposite side of the support arm. At least a portion of the one or more first mounting holes is located above a top of the support arm.

15 Claims, 11 Drawing Sheets

(56) References Cited

U.S. PATENT DOCUMENTS 1,024,349 A 4/1912 Mattern
1,033,440 A 7/1912 Moffat
1,052,447 A 2/1913 Armstrong
1,104,545 A 7/1914 Reitz
1,115,997 A 11/1914 Withrow
1,120,935 A 12/1914 Hammers
D47,004 S 2/1915 Martin
1,187,366 A 6/1916 Mozroll
1,333,163 A 3/1920 Eddy
D55,157 S 5/1920 Dubish
1,341,535 A 5/1920 Becker
1,384,246 A 7/1921 Durnell
1,445,372 A 2/1923 Wagner
1,451,764 A 4/1923 Dick
1,461,855 A 7/1923 Kroesser
1,492,210 A 4/1924 Kelly
1,498,849 A 6/1924 London
1,525,895 A 2/1925 Sherwood
1,530,167 A 3/1925 Friend
1,593,114 A 7/1926 Wyatt
1,596,506 A 8/1926 Morgan
1,658,815 A 2/1928 Oskamp
D76,109 S 8/1928 Vermillion
1,805,784 A 5/1931 Peterson
1,809,216 A * 6/1931 Quandt ..... A47H 27/00 248/300
D101,104 S 7/1936 Bushey
2,135,159 A 11/1938 Zbock
2,151,223 A 3/1939 Nayman, Sr.
2,234,099 A 3/1941 Westfall
2,240,225 A 4/1941 Place
2,288,303 A 6/1942 Ryan
2,293,168 A 8/1942 Pirone
2,374,787 A 5/1945 Spiegel
2,386,854 A 10/1945 Hilton
2,474,434 A 6/1949 Mentz
2,484,855 A * 10/1949 Press ..... A47H 1/122 248/265
2,644,191 A 7/1953 Meyer
2,720,373 A 10/1955 Bell
2,725,989 A 12/1955 Burkey
2,783,014 A 2/1957 Kenney
2,789,783 A 4/1957 Jones
2,848,184 A 8/1958 Kennedy
2,859,879 A 11/1958 Rogers
2,964,280 A * 12/1960 Rinaldi ..... A47H 1/122 248/265
3,049,327 A 8/1962 Caudell
3,104,086 A * 9/1963 Salzmann ..... A47H 1/122 248/262
3,199,823 A 8/1965 Stall
3,219,302 A 11/1965 Smith
3,289,992 A 12/1966 Brooks
3,312,442 A 4/1967 Moeller
3,430,908 A 3/1969 Kowalczyk
3,704,851 A * 12/1972 Cormier ..... A47H 1/10 248/265
3,724,085 A 4/1973 Wentworth
3,778,955 A 12/1973 Close
3,857,538 A 12/1974 Williamson
3,912,211 A * 10/1975 Topf ..... A47G 1/20 248/497
D242,986 S 1/1977 Inglis
4,039,136 A 8/1977 Dehart
4,060,905 A 12/1977 Light
D251,180 S 2/1979 Mader
4,140,294 A 2/1979 Zwarts
D253,162 S 10/1979 Sheehan
4,226,395 A 10/1980 Bellinger
4,291,996 A * 9/1981 Gilb ..... F16B 9/058 403/14
4,316,546 A 2/1982 Varon
4,322,050 A * 3/1982 Roach ..... A47H 1/122 248/265
4,455,007 A 6/1984 Varon
4,473,957 A 10/1984 Faulkner
4,509,713 A 4/1985 Hogg
D290,931 S 7/1987 Powell
4,684,095 A 8/1987 Athey
4,708,311 A 11/1987 Clausen
4,878,528 A 11/1989 Kobayashi
5,028,030 A 7/1991 Lewis
5,054,728 A 10/1991 Nigro, Jr.
5,103,574 A 4/1992 Levy
5,193,775 A 3/1993 Wagnon
5,195,570 A 3/1993 Marocco
5,398,900 A 3/1995 Schober
5,577,700 A 11/1996 Williams
D376,755 S 12/1996 Cox
5,678,703 A 10/1997 Sawyer
D389,035 S 1/1998 Smiley
5,802,729 A 9/1998 O'Brien
5,803,425 A * 9/1998 McCoy, II ..... A47G 1/1633 248/909
D408,722 S 4/1999 Sartini
D411,951 S * 7/1999 Baranski ..... D8/363
5,927,675 A 7/1999 Kratish
5,979,848 A * 11/1999 Kuthy ..... A47H 1/10 248/265
5,996,791 A 12/1999 Bibby
D420,567 S 2/2000 Laga
6,233,877 B1 5/2001 Monroe
6,325,349 B1 12/2001 Breaux
6,357,716 B1 3/2002 Kratish
D455,334 S 4/2002 Ivankovic
6,367,755 B1 4/2002 Arena
6,371,423 B1 4/2002 Miller
6,371,427 B1 4/2002 Johnson
6,409,140 B1 6/2002 Kratish
6,450,233 B1 9/2002 Becker
D464,013 S 10/2002 Adams
6,471,175 B1 10/2002 Kratish
6,481,584 B1 11/2002 Cantley
6,554,237 B1 4/2003 Weber
D478,804 S 8/2003 Titus
6,640,512 B1 11/2003 Kinnaman
6,695,276 B2 2/2004 Skorka
6,739,065 B2 5/2004 Hofmeister
7,128,124 B2 10/2006 Bibby
D542,897 S 5/2007 Harwanko
7,210,243 B2 5/2007 Schmidt
7,322,552 B1 * 1/2008 Lin ..... A47H 1/13 248/254
7,448,507 B1 11/2008 Abernathy, Jr.
D586,647 S 2/2009 Didehvar
7,509,752 B2 3/2009 Schmidt
D602,344 S 10/2009 Olien
D611,328 S 3/2010 Hanley
7,798,463 B2 * 9/2010 Morgenroth ..... A47F 5/0846 211/106.01
7,802,769 B1 9/2010 Lindsey
7,861,989 B2 1/2011 Cross
D638,282 S 5/2011 Robinson
8,011,635 B2 9/2011 Aleo
D646,957 S 10/2011 Syed
8,056,873 B1 11/2011 Hanely
8,069,507 B2 12/2011 Didehvar
D658,043 S 4/2012 Burr
8,185,981 B2 5/2012 Didehvar
8,214,938 B2 7/2012 Hanley
8,231,093 B2 7/2012 Tran
D667,295 S 9/2012 Harwanko
8,297,576 B2 10/2012 Mcleod
D670,522 S 11/2012 Cittadino
D670,944 S 11/2012 Cittadino
D672,178 S 12/2012 Walker
D672,990 S 12/2012 Lindo
D672,991 S 12/2012 Cittadino
8,341,775 B2 1/2013 Didehvar
8,356,782 B2 1/2013 Robichaud
D678,754 S 3/2013 Burr
8,418,975 B1 4/2013 Burr
D681,422 S 5/2013 Lindo

(56) References Cited

U.S. PATENT DOCUMENTS

| | | | | |
|---|---|---|---|---|
| D681,423 | S | 5/2013 | Walker | |
| D684,037 | S | 6/2013 | Harwanko | |
| D691,029 | S | 10/2013 | Didehvar | |
| D691,030 | S | 10/2013 | Lindo | |
| D691,031 | S | 10/2013 | Harwanko | |
| D693,209 | S | 11/2013 | Walker | |
| D696,573 | S | 12/2013 | Didehvar | |
| 8,640,890 | B2 | 2/2014 | Schiller | |
| D707,535 | S | 6/2014 | Burr | |
| 8,814,114 | B2 | 8/2014 | Baines | |
| 8,844,886 | B2 * | 9/2014 | Mejia | A47G 1/20 248/216.4 |
| 8,851,435 | B1 | 10/2014 | Bastien | |
| 8,869,999 | B2 | 10/2014 | Lindo | |
| 8,978,228 | B2 | 3/2015 | Didehvar | |
| 8,979,911 | B2 | 3/2015 | Martineau | |
| 9,009,878 | B2 | 4/2015 | Baines | |
| 9,021,627 | B2 | 5/2015 | Parker | |
| 9,107,529 | B2 | 8/2015 | Didehvar | |
| 9,131,795 | B2 | 9/2015 | Didehvar | |
| 9,216,045 | B2 | 12/2015 | Martineau | |
| D746,667 | S | 1/2016 | Vaccaro | |
| 9,271,592 | B2 | 3/2016 | Didehvar | |
| 9,474,421 | B2 | 10/2016 | Baines | |
| 9,486,913 | B2 | 11/2016 | Thieman | |
| 9,532,663 | B2 | 1/2017 | Nilsson | |
| 9,726,304 | B2 | 8/2017 | Heath | |
| D805,880 | S | 12/2017 | Bright | |
| D811,205 | S | 2/2018 | Hanley | |
| D813,021 | S | 3/2018 | Hanley | |
| D813,022 | S | 3/2018 | Hanley | |
| 10,047,903 | B2 | 8/2018 | Bruno | |
| 10,064,512 | B2 | 9/2018 | Mcmillion | |
| 10,070,748 | B2 | 9/2018 | Hanley | |
| 10,092,126 | B2 | 10/2018 | Baines | |
| 10,094,167 | B2 | 10/2018 | Odish | |
| 10,123,647 | B1 | 11/2018 | Mustafa | |
| D834,925 | S | 12/2018 | Hanley | |
| D834,926 | S | 12/2018 | Hanley | |
| D834,927 | S | 12/2018 | Hanley | |
| D838,610 | S | 1/2019 | Odish | |
| D847,613 | S | 5/2019 | Hanley | |
| 10,278,529 | B2 | 5/2019 | Baines | |
| 10,285,527 | B2 | 5/2019 | Mullet | |
| D856,785 | S | 8/2019 | Hanley | |
| 10,376,086 | B1 | 8/2019 | Mustafa | |
| D858,259 | S | 9/2019 | Hanley | |
| D858,260 | S | 9/2019 | Hanley | |
| D859,963 | S | 9/2019 | Hanley | |
| 10,441,098 | B2 | 10/2019 | Bruno | |
| 10,448,773 | B2 | 10/2019 | Muñiz | |
| 10,648,492 | B2 | 5/2020 | Hanley | |
| 10,724,678 | B1 | 7/2020 | Elliott | |
| D893,284 | S | 8/2020 | Hanley | |
| 10,765,247 | B2 | 9/2020 | Moss | |
| 11,002,302 | B2 | 5/2021 | Hanley | |
| 11,092,176 | B2 | 8/2021 | Hanley | |
| 11,111,942 | B2 | 9/2021 | Cogburn | |
| 11,266,263 | B2 | 3/2022 | Moss | |
| 11,452,398 | B2 * | 9/2022 | Berman | A47H 1/142 |
| 11,608,628 | B2 * | 3/2023 | Allen | E04B 1/388 |
| 2002/0066842 | A1 | 6/2002 | Curry | |
| 2003/0071181 | A1 | 4/2003 | Valiulis | |
| 2004/0159766 | A1 | 8/2004 | Skorka | |
| 2004/0195477 | A1 | 10/2004 | Rivellino | |
| 2005/0218284 | A1 | 10/2005 | Kurrasch | |
| 2006/0130983 | A1 | 6/2006 | Nien | |
| 2008/0156952 | A1 | 7/2008 | Nathan | |
| 2008/0237434 | A1 | 10/2008 | Lin | |
| 2009/0101609 | A1 | 4/2009 | Batshon | |
| 2009/0193938 | A1 | 8/2009 | Mentor | |
| 2010/0224749 | A1 | 9/2010 | Tran | |
| 2012/0001039 | A1 | 1/2012 | Mcduff | |
| 2012/0217362 | A1 * | 8/2012 | Affonso | A47H 1/142 248/222.14 |
| 2013/0043357 | A1 | 2/2013 | Mcleod | |
| 2013/0082017 | A1 | 4/2013 | Tang | |
| 2013/0099080 | A1 | 4/2013 | Baines | |
| 2013/0200024 | A1 | 8/2013 | Lindo | |
| 2013/0341474 | A1 | 12/2013 | Baines | |
| 2014/0360960 | A1 | 12/2014 | Didehvar | |
| 2015/0108304 | A1 | 4/2015 | Larsen Roldan | |
| 2015/0265086 | A1 | 9/2015 | Hanley | |
| 2015/0272353 | A1 | 10/2015 | Christodoulou | |
| 2015/0297038 | A1 | 10/2015 | Vaccaro | |
| 2016/0113447 | A1 | 4/2016 | Walker | |
| 2016/0215922 | A1 | 7/2016 | Mcduff | |
| 2016/0286999 | A1 * | 10/2016 | Mcmillion | F16B 2/22 |
| 2017/0071390 | A1 | 3/2017 | Moss | |
| 2018/0014680 | A1 | 1/2018 | Hanley | |
| 2018/0064279 | A1 | 3/2018 | Hanley | |
| 2018/0098656 | A1 | 4/2018 | Baines | |
| 2018/0199747 | A1 | 7/2018 | Moss | |
| 2018/0306219 | A1 | 10/2018 | Hanley | |
| 2019/0063671 | A1 | 2/2019 | Mcduff | |
| 2019/0099034 | A1 | 4/2019 | Hanley | |
| 2019/0282017 | A1 | 9/2019 | Hanley | |
| 2020/0200199 | A1 | 6/2020 | Hanley | |
| 2020/0217338 | A1 | 7/2020 | Hanley | |
| 2020/0305629 | A1 * | 10/2020 | Hanley | A47H 1/142 |
| 2020/0325925 | A1 * | 10/2020 | Cogburn | F16B 15/0053 |
| 2020/0345167 | A1 * | 11/2020 | Klowan | F16M 13/027 |
| 2021/0252678 | A1 | 8/2021 | Moss | |
| 2021/0364027 | A1 | 11/2021 | Cogburn | |
| 2023/0165396 | A1 | 6/2023 | Berman | |

OTHER PUBLICATIONS

U.S. Appl. No. 17/890,106, filed Aug. 17, 2022.
U.S. Appl. No. 18/164,430, filed Feb. 3, 2023.
U.S. Appl. No. 16/749,770, filed Jan. 22, 2020, 43 pages.
U.S. Appl. No. 17/879,640, filed Aug. 2, 2022, 17 pages.
U.S. Appl. No. 17/964,736, filed Oct. 12, 2022.

* cited by examiner

FIG. 12
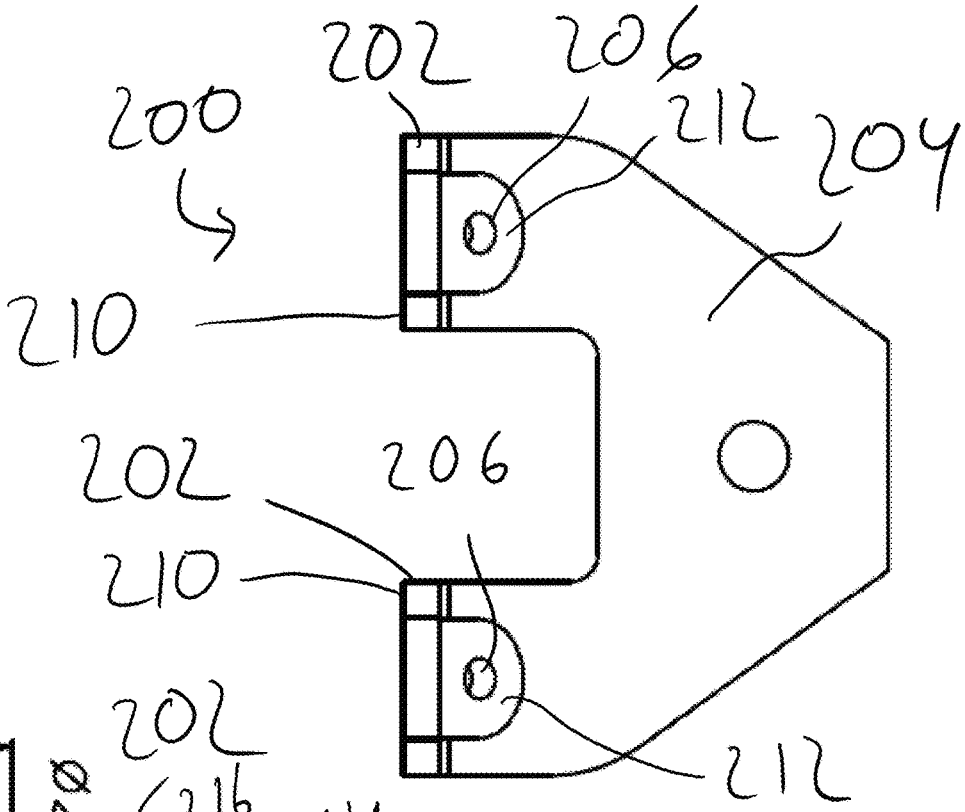
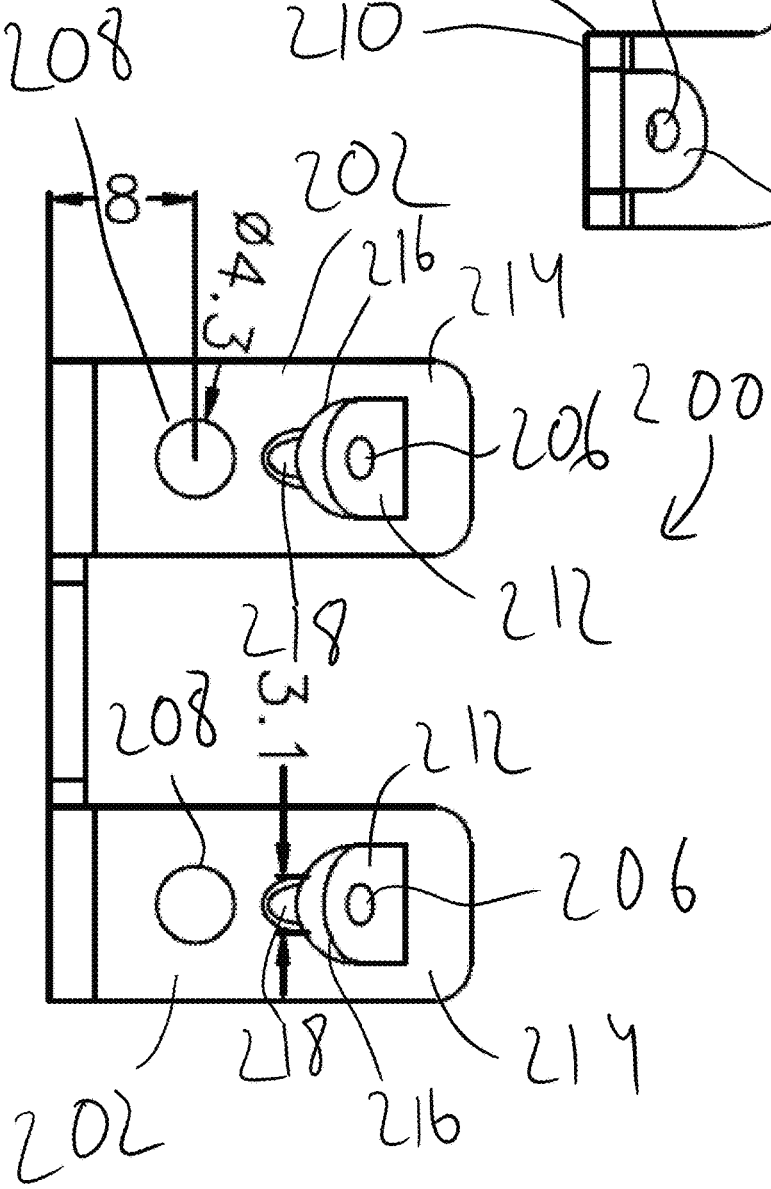
FIG. 13

MOUNTING BRACKET

FIELD

This disclosure relates to mounting brackets and, in particular, to mounting brackets for wall mounted items.

BACKGROUND

Many homes include wall mounted hardware, for example, curtain rod systems. Installation of curtain rod systems can be difficult and cumbersome, particularly for homeowners attempting to mount such curtain rod systems. For example, for many curtain rod systems, to securely mount the curtain rod system to a wall requires the installer to follow several steps and may require the use of several different types of tools or fasteners. Moreover, while attempting to install the curtain rod system, the installer may find that due to special circumstances the curtain rod system is not able to be mounted to the wall according to the mounting method specified in the instructions. Homeowner's installing such wall mounted hardware desire hardware that can be easily installed in a wide variety of applications and that remains firmly secured to the wall during use.

BRIEF DESCRIPTION OF THE DRAWINGS

FIG. 12 is a top plan view of the mounting bracket of FIG. 10.

FIG. 13 is a front elevation view of the mounting bracket of FIG. 10.

DETAILED DESCRIPTION

Figure 1:
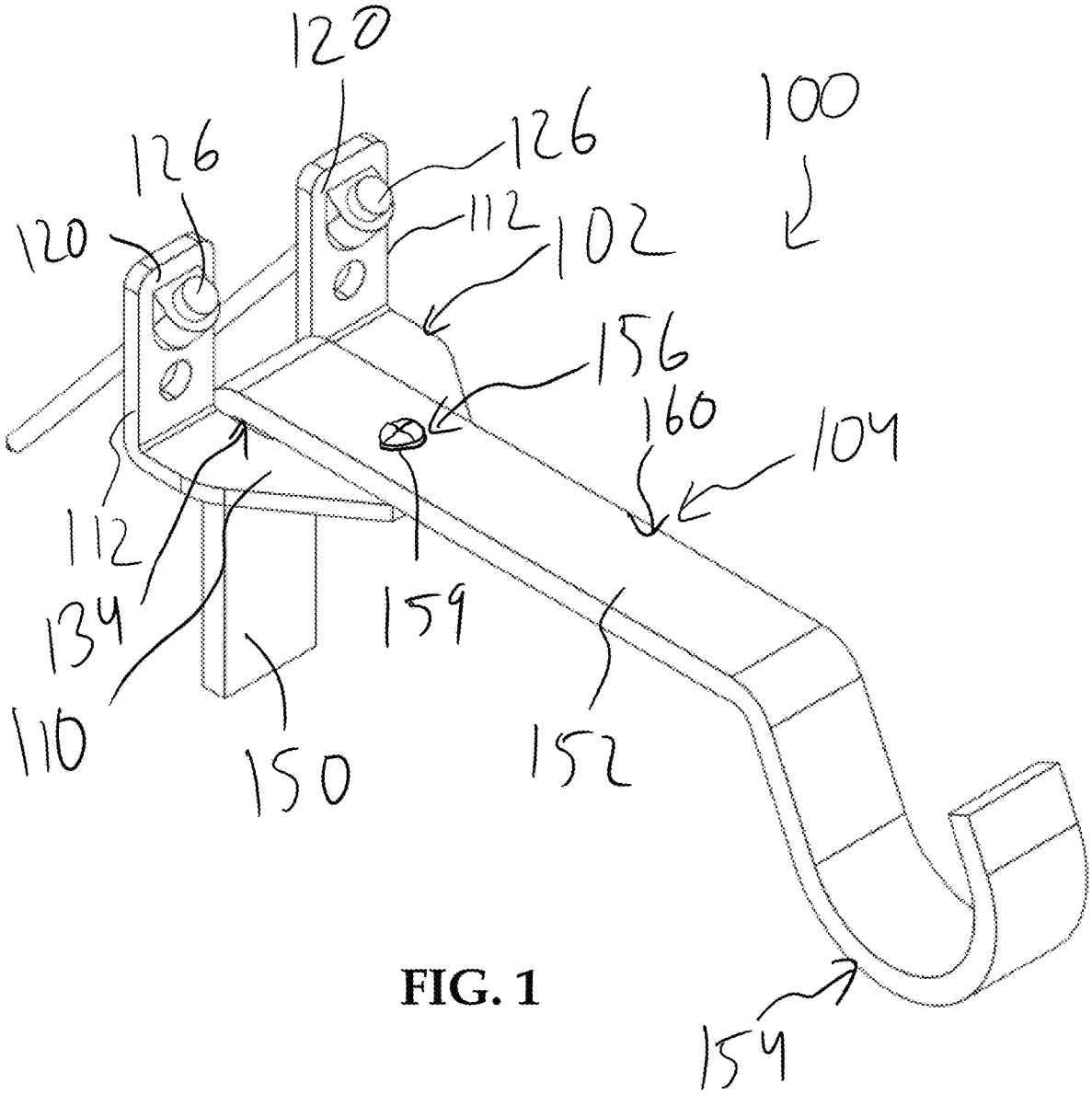
FIG. 1 is a front perspective view of a rod bracket.
Figure 2:
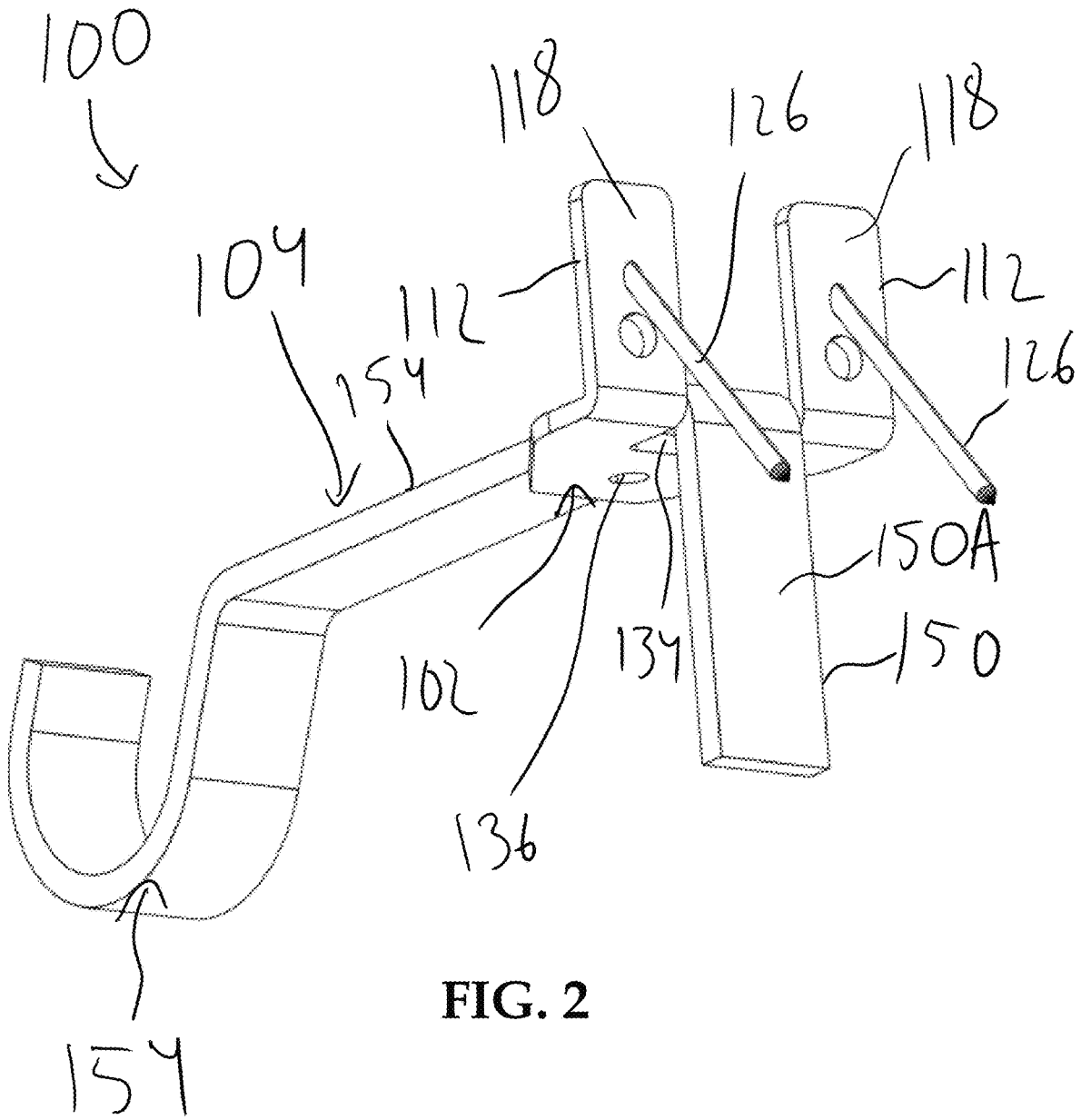
FIG. 2 is a rear perspective view of the rod bracket of FIG. 1.
Figure 3:
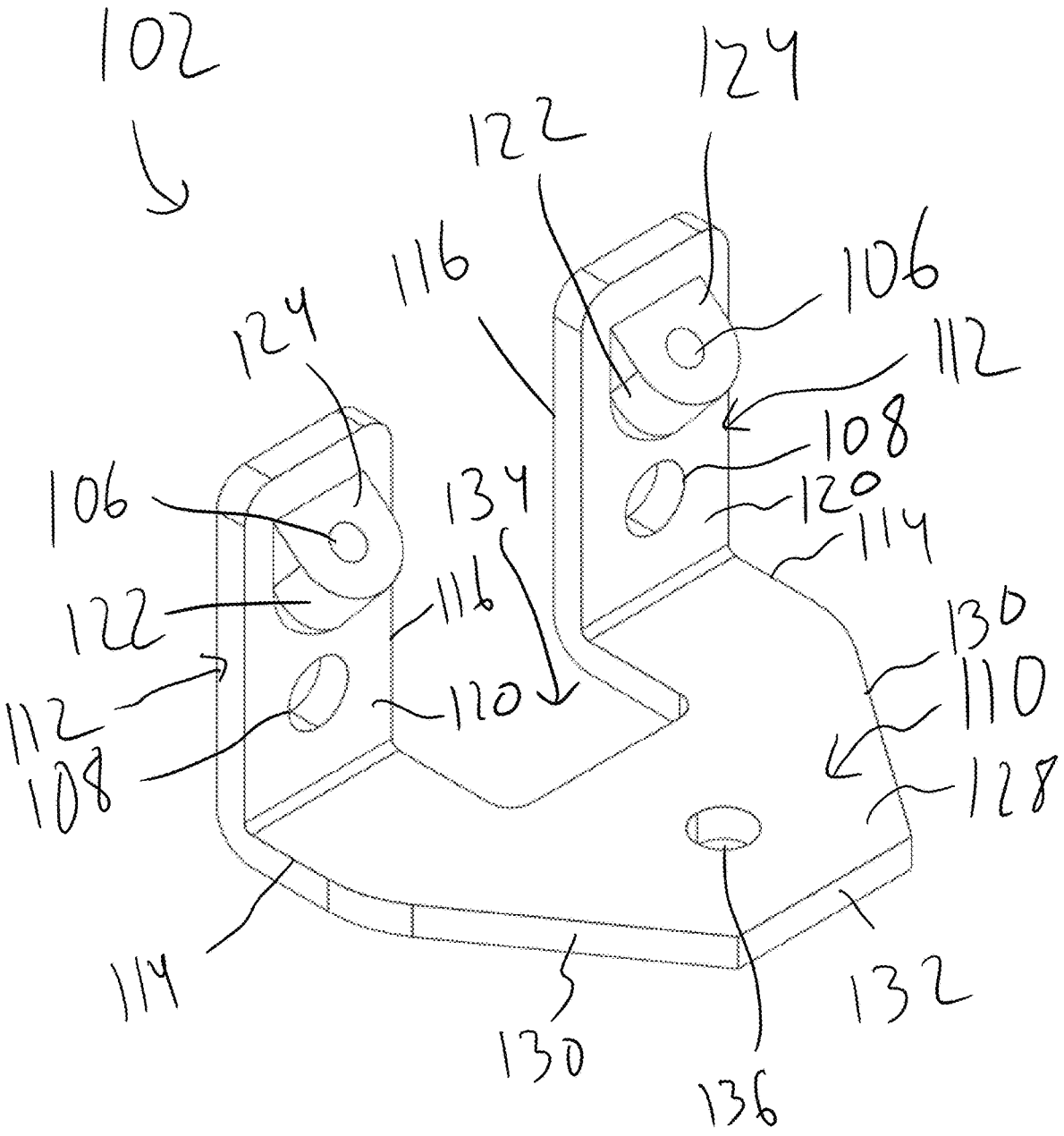
FIG. 3 is a top perspective view of a mounting bracket of the rod bracket of FIG. 1.
Figure 4:
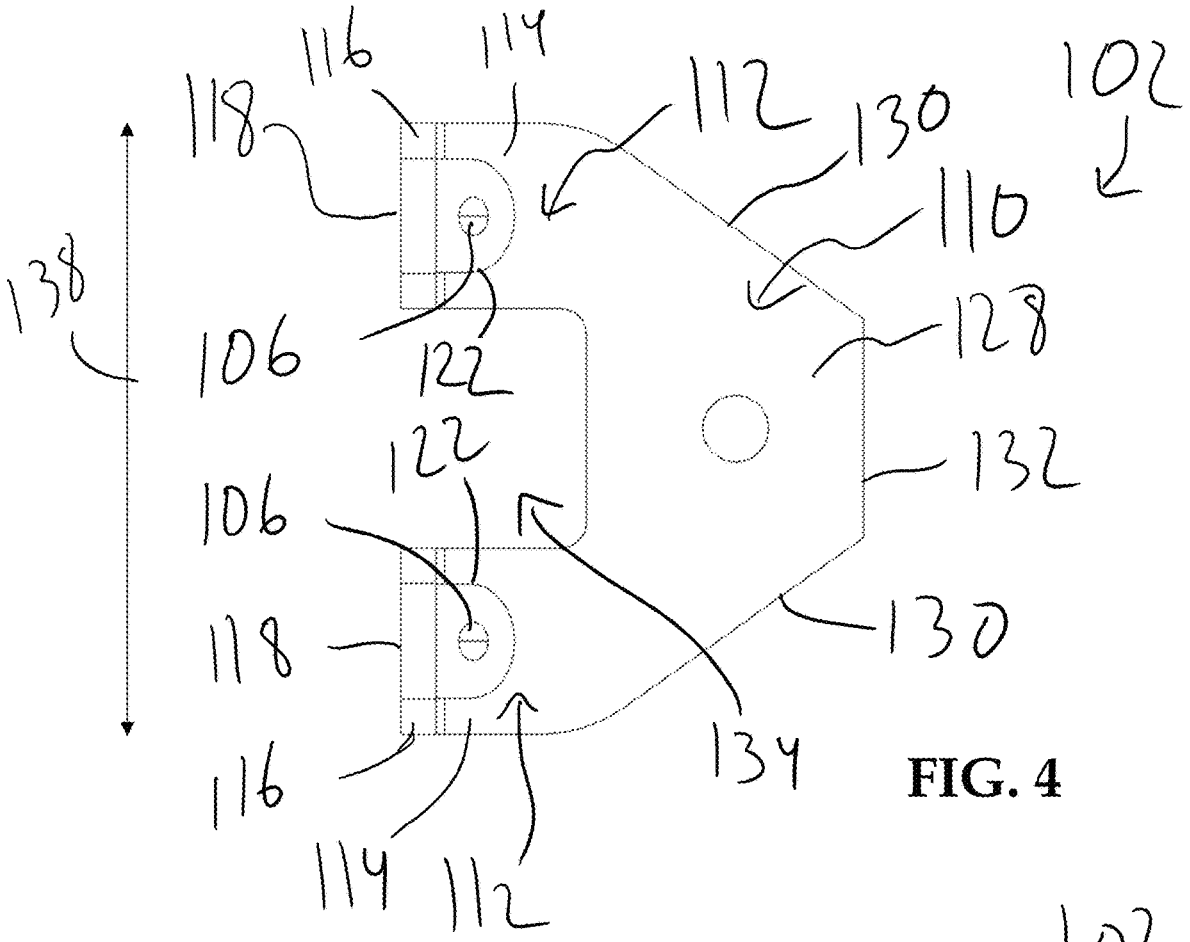
FIG. 4 is a top plan view of the mounting bracket of FIG. 3.
Figure 5:
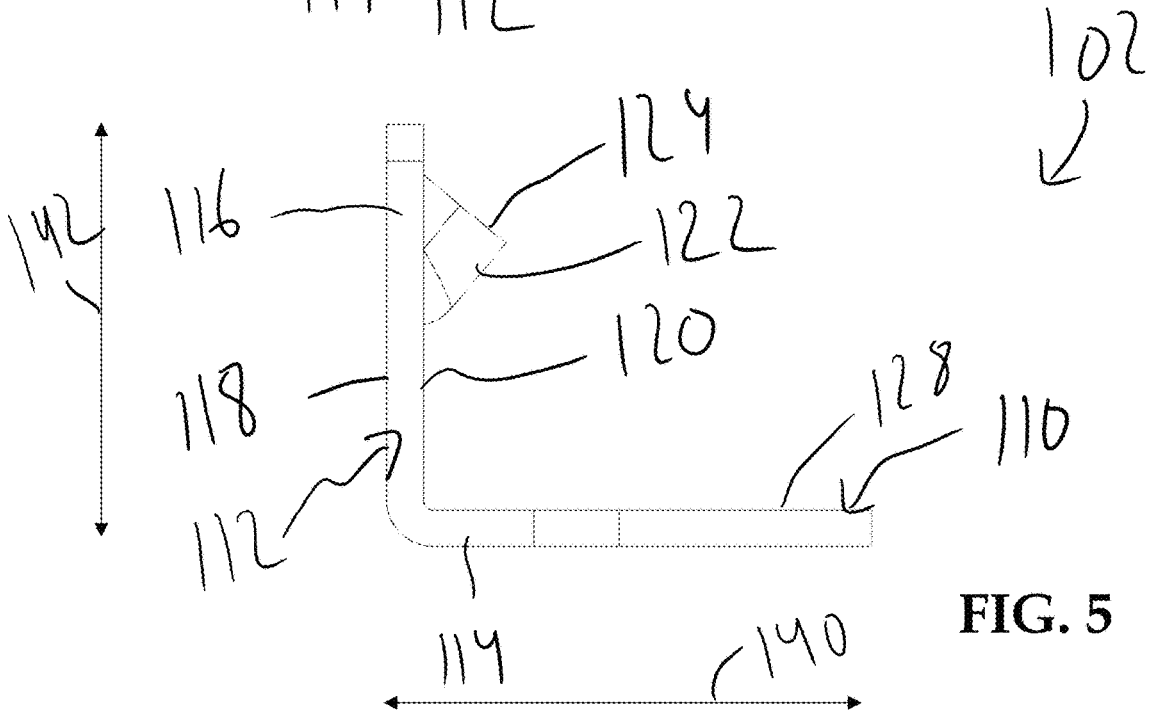
FIG. 5 is a left side elevation view of the mounting bracket of FIG. 3.
Figure 6:
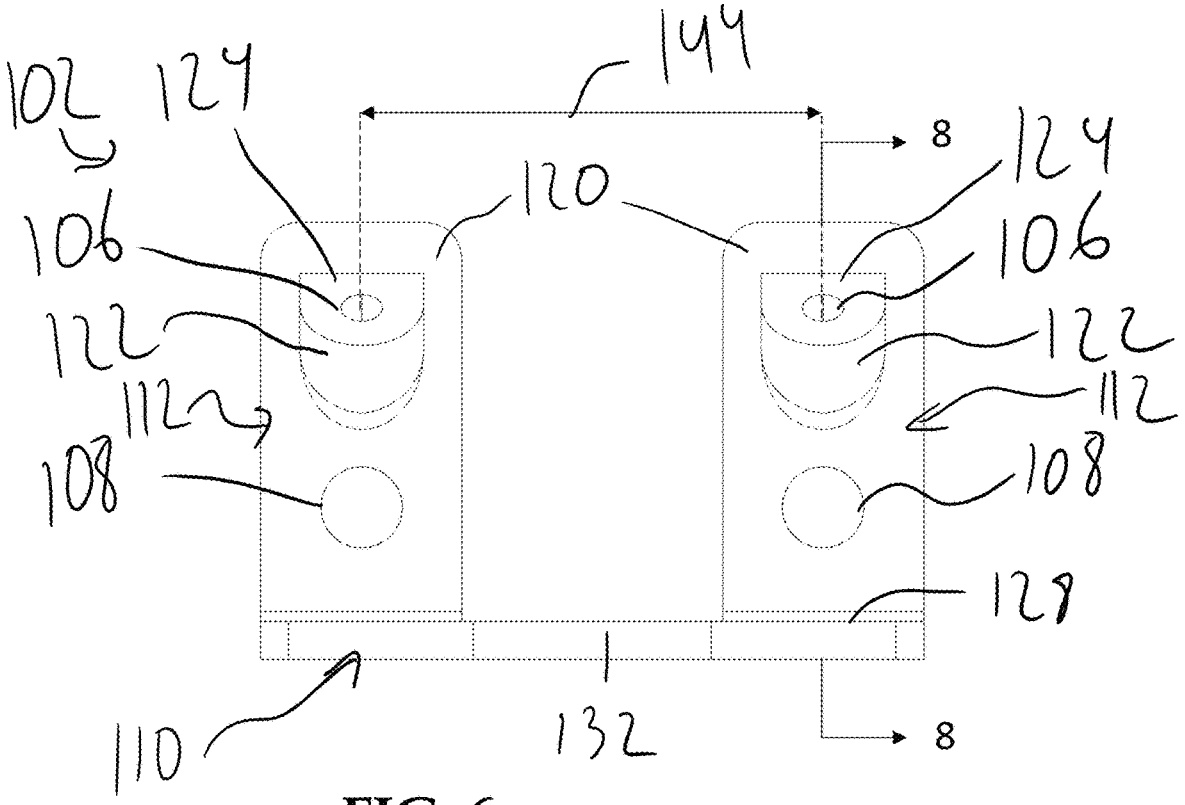
FIG. 6 is a front elevation view of the mounting bracket of FIG. 3.
Figure 7:
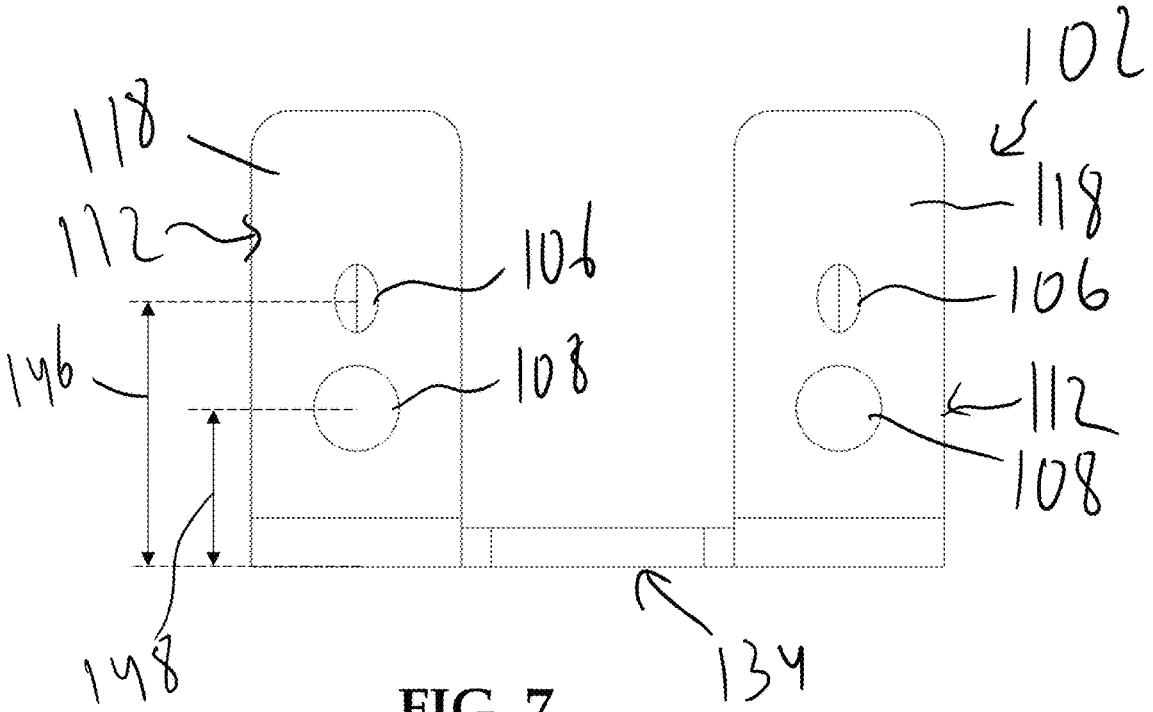
FIG. 7 is a rear elevation view of the mounting bracket of FIG. 3.
Figure 8:
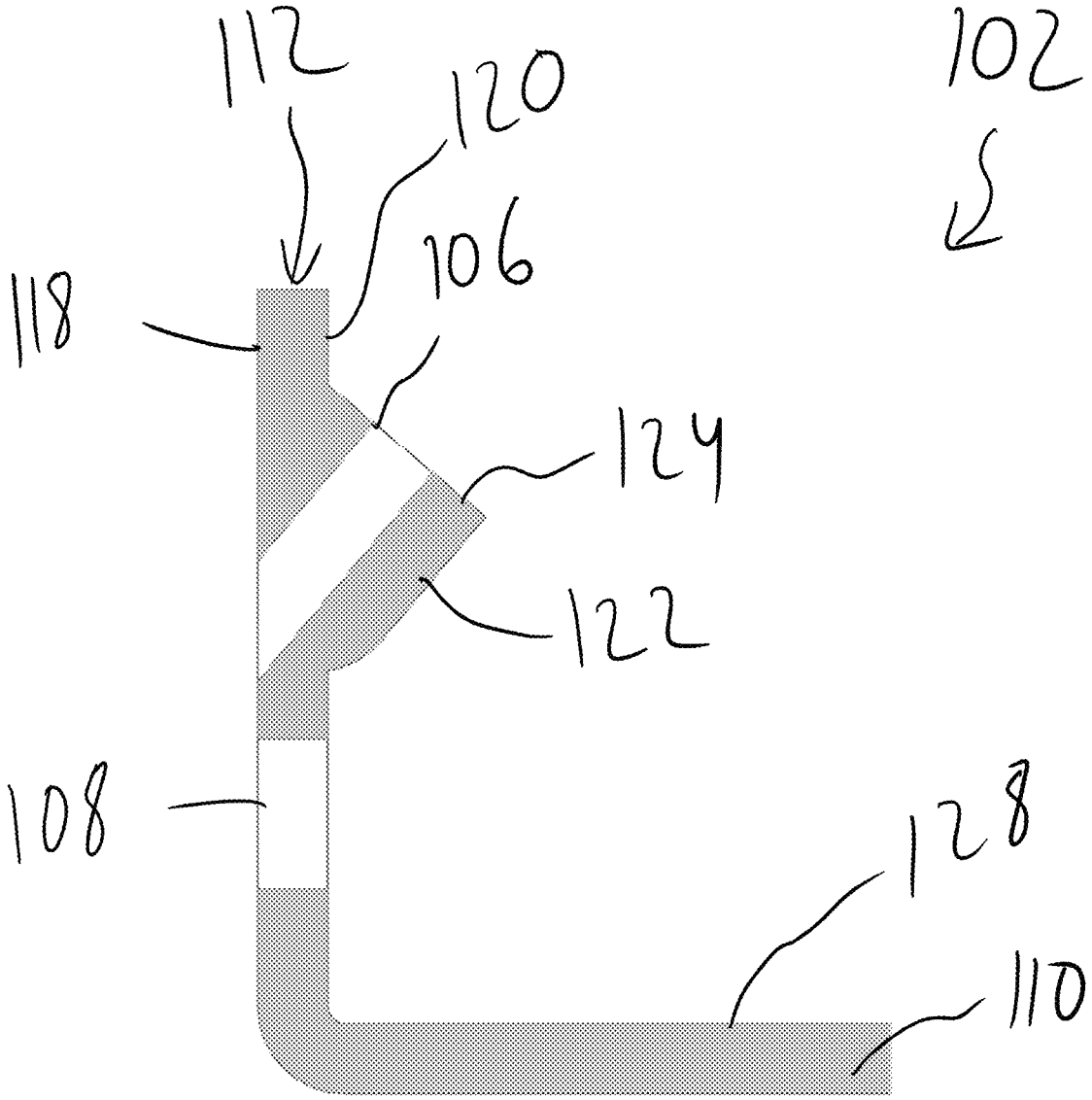
FIG. 8 is a cross-sectional view of the mounting bracket of FIG. 3 taken along line 8-8 of FIG. 6.

With reference to FIGS. 1-2, a multiple piece bracket 100 is provided. The bracket 100 may be used with another bracket 100 to support a rod, such as sheer or drapery rod, across the two brackets 100. The bracket 100 includes a mounting bracket 102 and hardware component such as a rod holder 104. While the discussion below primarily describes the bracket 100 including the rod holder 104, other hardware components may similarly be mounted to the mounting bracket 102 including baskets, lights, shelf supports, toilet paper holders, and other wall mounted hardware.

With reference to FIGS. 3-8, the mounting bracket 102 includes a first pair of mounting holes 106. The first pair of mounting holes 106 are spaced horizontally from one another at a mounting portion of the mounting bracket 102 and to be generally at or above the rod holder 104 when the rod holder 104 is combined with the mounting bracket 102 (see FIGS. 1-2). The first pair of mounting holes 106 extend obliquely through the mounting bracket 102 to guide a fastener into a mounting surface at an oblique angle. For example, the first pair of mounting holes 106 may direct the fasteners at a downward angle (e.g., 50 degrees) into the mounting surface which increases the amount of weight the bracket 100 can bear once mounted to the mounting surface. It has also been found that having the mounting holes at the top of the mounting bracket 102 (and generally at or above the rod holder 104) and spaced laterally from one another increases the load capacity of the bracket 100 over traditional L-shaped brackets where the mounting holes are aligned vertically and located below the arm.

The mounting bracket 102 may further include a second pair of mounting holes 108. The second pair of mounting holes 108 are also spaced horizontally from one another at the mounting portion of the mounting bracket 102 and generally at or above the rod holder 104 which, as discussed above, increases the load capacity of the bracket 100 over traditional L-shaped brackets. Having two sets of mounting holes provides the installer with options for attaching the mounting bracket 102 to a mounting surface. Thus, for example, in applications where the first pair of mounting holes 108 cannot be used, the installer may use the second pair of mounting holes 108 rather than seeking a different bracket 100.

The mounting bracket 102 includes a supporting portion, such as main body 110, and a mounting portion, such as arms 112, extending from the main body 110. The arms 112 extend substantially parallel to one another. Each arm 112 includes a proximal segment 114 and a distal segment 116. The proximal segment 114 extends in the same plane as the main body 110, and the distal segment 116 extends upward generally perpendicular to the proximal segment 114. Each distal segment 116 defines one of the mounting holes 106 and one of the mounting holes 108. The distal segments 116 include a rear surface 118 that is positioned against a mounting surface of a structure (e.g., a wall) when the mounting bracket 102 is secured to the mounting surface. The rear surface 118 may be generally planar to extend substantially parallel to the mounting surface. The distal segments 116 further include a front surface 120 opposite the rear surface 118.

As illustrated, the mounting holes 106, 108 are located on the distal segments 116 laterally outside of the rod holder 104, one of each pair of mounting holes 106, 108 on each side of the rod holder 104. More specifically, one hole 106 is located on one distal segment 116 outside the rod holder 104 on one side and the other hole 106 is located on the other distal segment 116 outside the rod holder 104 on the other side. And similarly for the second pair of mounting holes 108, each hole 108 is located on one of the distal segments 116 on laterally opposite sides of the rod holder 104. The lateral spacing of the mounting holes 106, 108 has been found to increase the holding strength of the bracket 100. As illustrated, the mounting holes 106, 108 are above the rod holder 104 which also has been found to increase the load capacity of the bracket 100. The mounting holes 106, 108 also are located at the top of the bracket 100 for ease of mounting.

The mounting bracket 102 includes a protrusion 122 extending obliquely from the front surface 120 of each of the distal segments 116 of the arms 112. The protrusions 122 terminate at end faces 124 and define at least in part the mounting holes 106. The mounting holes 106 are passages extending through the protrusions 122 and through the rear surface 118 of the arms 112. The mounting holes 106 may extend obliquely to the front surface 120 and/or rear surface 118 of the distal segment 116 of the arms 112 (see FIG. 8). The mounting holes 106 may extend at an angle of approximately 40-60 degrees relative to the rear surface 118. As one specific example, the mounting holes 106 may extend at approximately 50 degrees relative to the rear surface 118.

The mounting holes 106 are sized to receive fasteners 126, such as, for example, nails or screws, therethrough for securing the mounting bracket 102 to a mounting surface of a structure, such as a wall or a door. The first pair of mounting holes 106 may be positioned above the second pair of mounting holes 108 or further from the proximal segment 114 of the arms 112 to provide space for an installer to drive the fasteners through the first pair of mounting holes 106. For example, a user may use a hammer to drive a nail through the mounting holes 106. Spacing the mounting holes 106 further from the main body 110 and proximal segment 114 of the arms 112 provides clearance for using the hammer. The orientation of the mounting holes 106 through the arms 112 guides or directs the fasteners 126 as they are extended into the mounting surface such that the fasteners 126 extend into the mounting surface at an oblique angle. For example, as shown in FIGS. 1-2, the fasteners 126 extend from the mounting bracket 102 obliquely to the rear surface 118. Including the protrusions 122 on the front surface 120 of the distal segment 116 increases the length of the mounting holes 106 which aids in holding the fasteners at an angle relative to the mounting surface as the fasteners are extended into the mounting surface. Extending the fasteners 126 into the mounting surface at a downward angle (e.g., 50 degrees) increases the amount of weight the mounting bracket 102 can bear once mounted to the mounting surface.

The mounting bracket 102 includes the second pair of mounting holes 108 that may be used for mounting the mounting bracket 102 to a mounting surface. The mounting holes 108 extend from the front surface 120 and through the rear surface 118. The mounting holes 108 may extend through the distal segment 116 of the arm 112 substantially perpendicular to the rear surface 118. Fasteners may be extended through the holes 108 and into the mounting surface to secure mounting bracket 102 to the mounting surface. As an example, where the mounting surface is drywall, wall anchors may be inserted into the drywall and screws may be extended through the mounting holes 108 and into the wall anchors to attach the mounting bracket 100 to the wall. The mounting holes 108 may be used to mount the mounting bracket 102 to a mounting surface as an alternative mounting method or in addition to using the mounting holes 106 of the protrusions 122. For example, in some applications, an installer may not be able to use the first pair of mounting holes 106 and, instead, may use the second pair of mounting holes 108. For instance, a wall may not be able to accept nails extended through the first set of mounting holes 106 (e.g., where the wall is concrete, metal, or brick) but may be able to accept screws extended through the second set of mounting holes 108 into the wall. Thus, the mounting bracket 102 can be installed according to two different approaches enabling the mounting bracket to be installed in a greater variety of applications. In some forms, the second mounting holes 108 are positioned above the protrusions 122 having the first mounting holes 106.

The main body 110 may be a plate and/or may have a substantially planar support surface 128 on an upper side thereof. The sides 130 of the main body 110 may angle inward from the arms 112 to a front end 132 such that the main body 110 has a substantially trapezoidal shape. A gap 134 is defined between the proximal segments 114 of the arms 112. The gap 134 is sized to receive a portion of the rod holder 104, as described further below. The main body 110 may include a threaded hole 136 used to secure the mounting bracket 102 and the rod holder 104 together. The mounting bracket 102 may be formed of a rigid material, such as a plastic or a metal.

In one non-limiting example, the mounting bracket 102 has a width 138 of 34.90 millimeters (mm), a depth 140 of 26.4 mm, and a height 142 of 23 mm. The lateral spacing 144 between the centers of the mounting holes 106, 108 may be 24.27 mm. The height 146 of the first set of mounting holes 106 exiting the rear surface 118 of the distal segment 116 of the arms 112 may be 13.38 mm. The height 148 of the second set of mounting holes 108 may be 8 mm.

With reference again to FIGS. 1-2, the rod holder 104 includes a base portion, such as a leg 150, a support arm 152, and a receptacle, such as a cradle 154. The leg 150 and a portion of the support arm 152 form an attachment portion 156 of the rod holder 104. The leg 150 and support arm 152 are angled relative to one another, such as at 90 degrees. The leg 150 is sized to extend through the gap 134 of the mounting bracket 102. The leg 150 has a rear surface 150A that is designed to contact and/or extend along the mounting surface when attached to the mounting bracket 102 to counter the force applied at the cradle 154 of the rod holder 104 (e.g., by a rod). The support arm 152 is designed to rest on the main body 110 of the mounting bracket 102. The support arm 152 defines a hole 158 that aligns with the hole 136 of the main body 110 of the mounting bracket 102. A fastener, such as a screw 159, may be extended through the holes 136, 158 to affix the support arm 152 to the main body 110. The hole 158 of the support arm 152 may be a threaded hole.

A portion of the support arm 152 and the cradle 154 form a support portion 160 of the rod holder 104. The support arm 152 extends from an end of the leg 150 to the cradle 154. The cradle 154 has an arcuate shaped surface that is sized to receive and support a rod (e.g., a curtain rod). The rod holder 104 may be formed of a rigid material such as a plastic or a metal.

Figure 9:
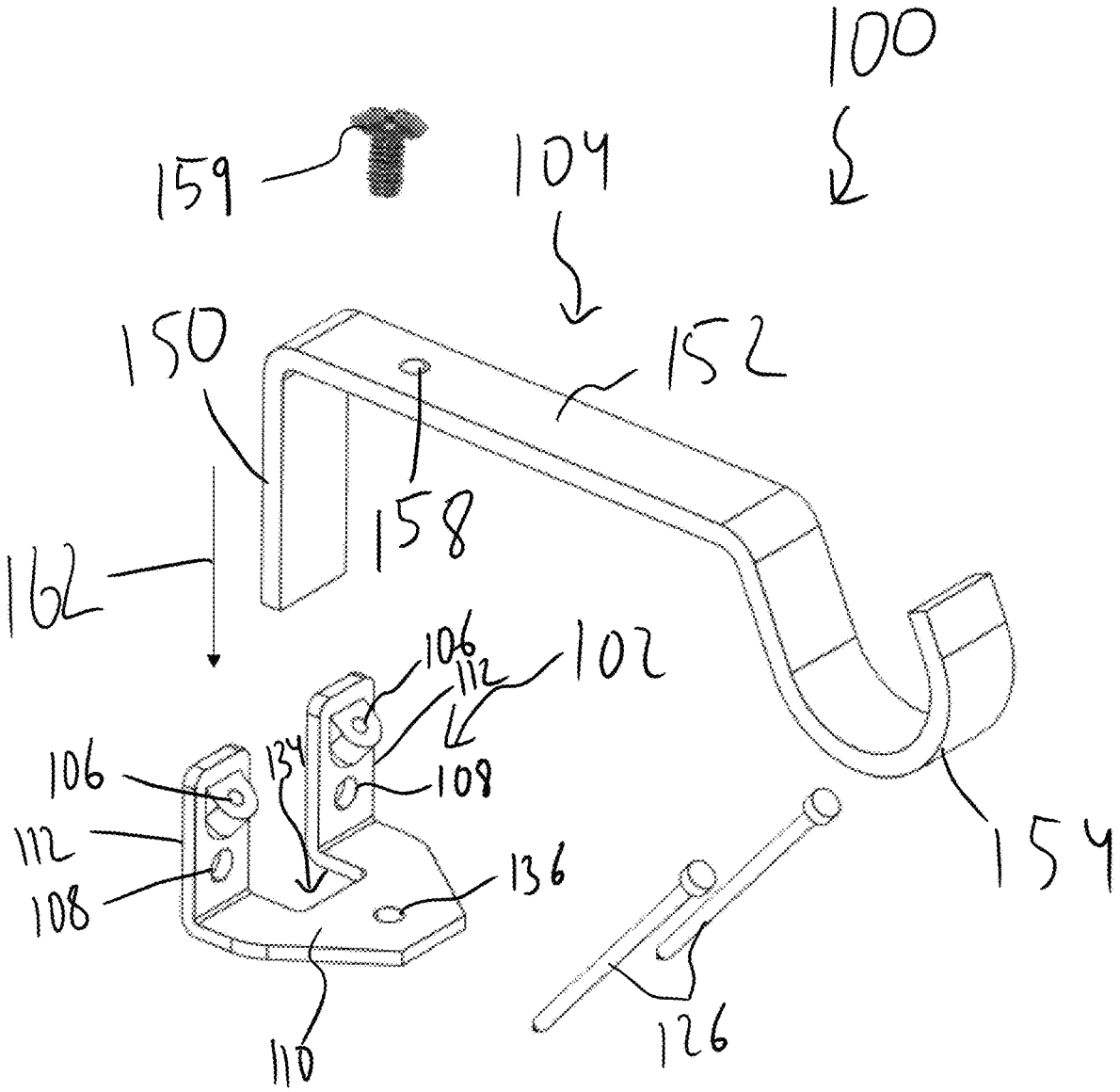
FIG. 9 is a perspective view illustrating attachment of a rod holder of the rod bracket of FIG. 1 to the mounting bracket.
Figure 10:
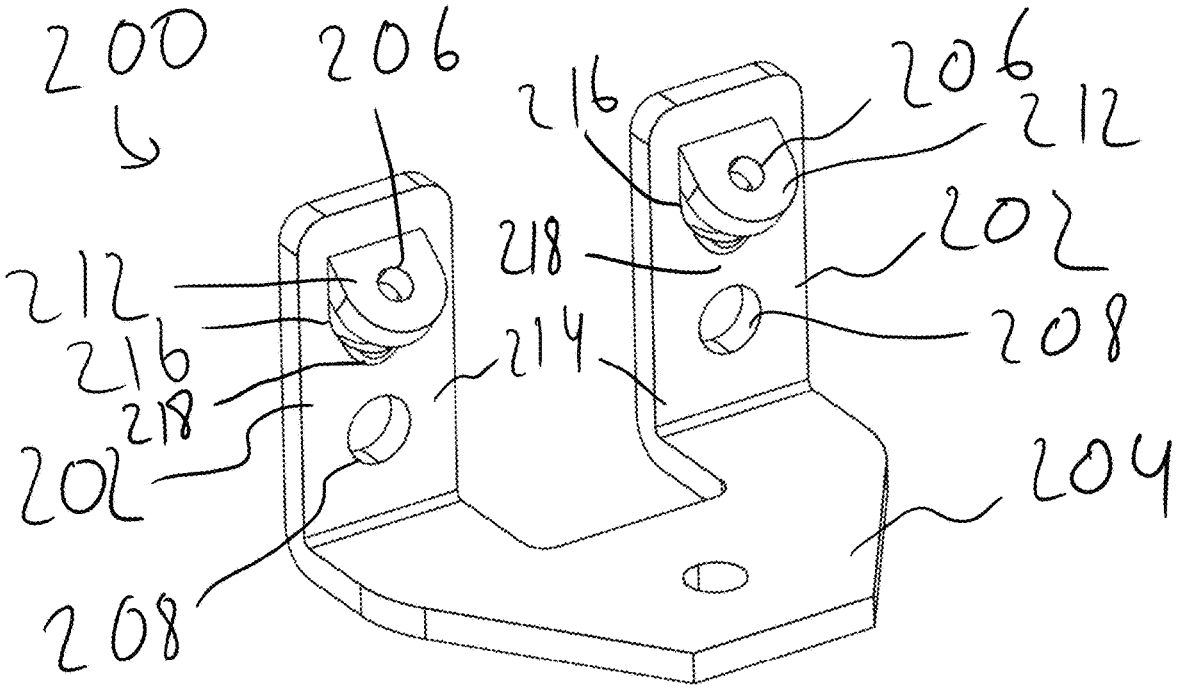
FIG. 10 is a front perspective view of a mounting bracket according to another embodiment.
Figure 11:
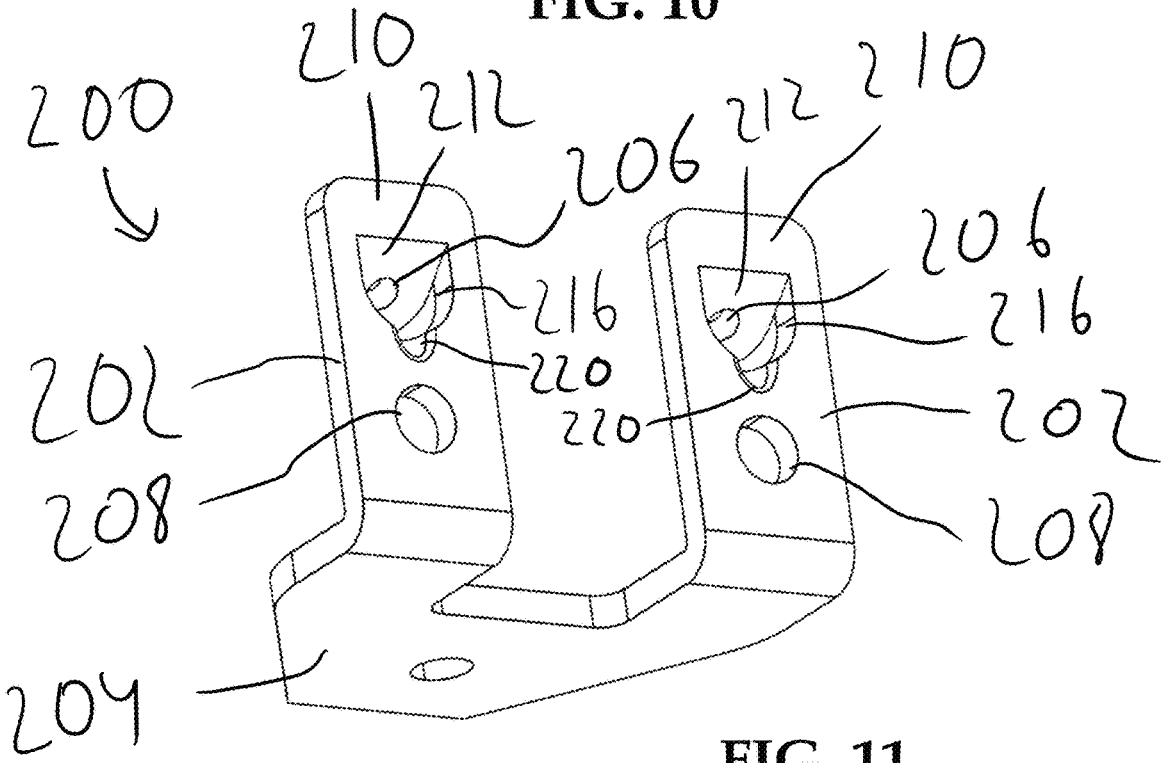
FIG. 11 is a rear perspective view of the mounting bracket of FIG. 10.
Figure 14:
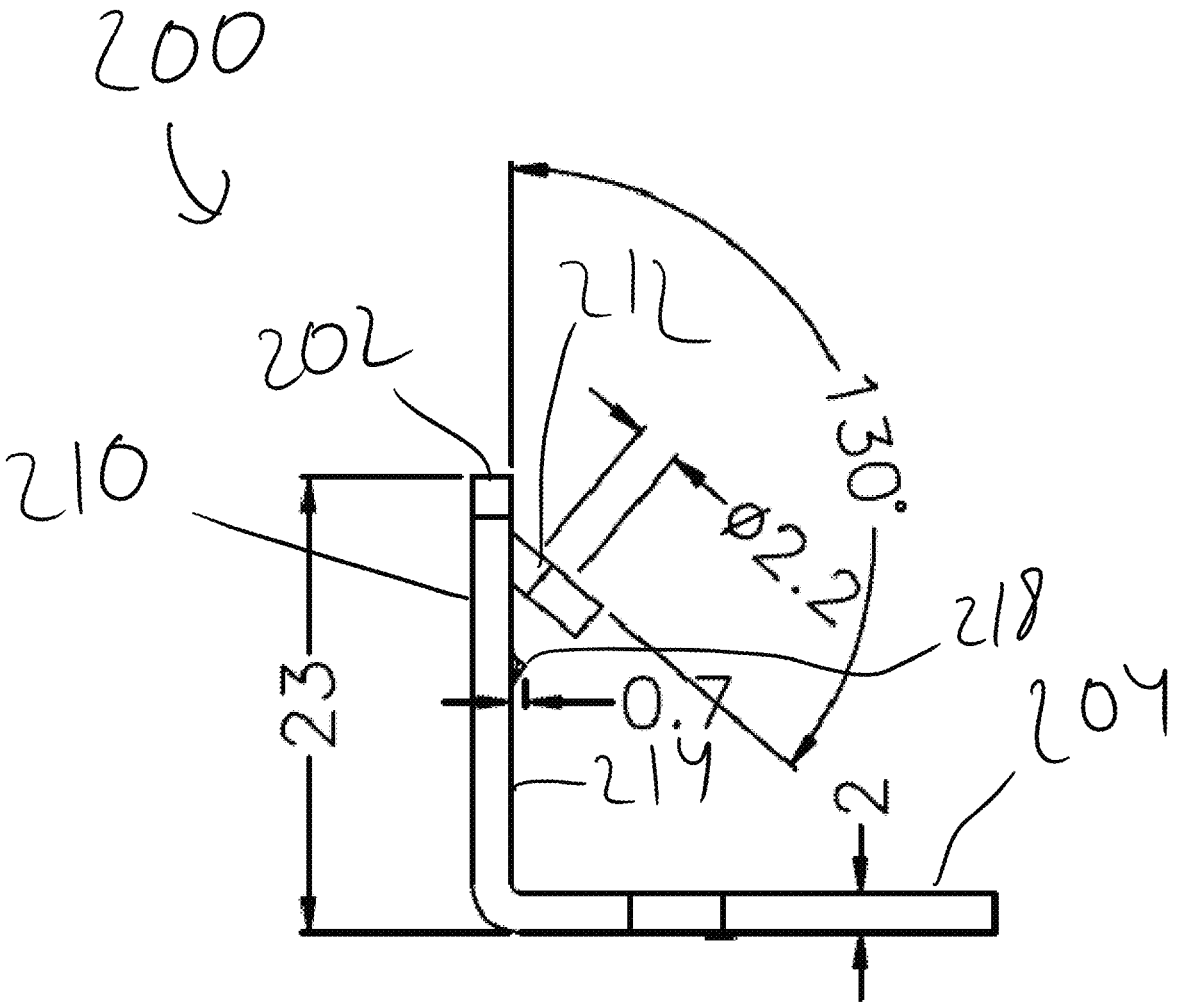
FIG. 14 is a left side elevation view of the mounting bracket of FIG. 10.

With reference to FIG. 9, the bracket 100 may be attached to a mounting surface, for example, to support a rod. The mounting bracket 102 may be positioned on the mounting surface at a desired location. Fasteners 126 may be extended through each of the first pair of mounting holes 106 and into the mounting surface to secure the mounting bracket 102 to the mounting surface. The mounting holes 106 extend obliquely to the rear surface 118 of the arms 112 and guide the fasteners at a downward angle as they extend into the mounting surface (see FIGS. 1-2). Alternatively, fasteners may be extended through the second pair of mounting holes 108 and into the mounting surface to secure the mounting bracket 102 to the mounting surface. In some approaches, fasteners may be extended through each of the holes of the sets of mounting holes 106, 108 to secure the mounting bracket 102 to the mounting surface. In some approaches, fasteners may be extended through one hole of the first pair of mounting holes 106 and one hole of the second pair of mounting holes 108 of opposite arms 112 to secure the mounting bracket 102 to the mounting surface.

The rod holder 104 may then be attached to the mounting bracket 102. The leg 150 may be moved in direction 162 to insert the leg 150 through the gap 134 between the arms 112 and between the main body 110 and the mounting surface. The leg 150 may be moved in direction 162 until the support arm 152 rests on the main body 110 of the mounting bracket 102. The leg 150 may be moved rearward to position the rear surface 150A of leg 150 against the mounting surface. The engagement of leg 150 against the mounting surface may inhibit the rod holder 104 from pivoting substantially relative to the mounting bracket 102 by countering the force applied to the cradle 154 by weight of the rod and/or items supported by the rod (e.g., a curtain). A fastener, such as the screw 159, may be extended through the hole 158 of the support arm 152 and through hole 136 of the mounting bracket 102 to secure the rod holder 104 to the mounting bracket 102. A rod may be positioned to extend through the cradle 154 to be supported by the bracket 100.

In other embodiments, other types of hardware components may be mounted to the mounting bracket similar to the rod holder 104 described above. For example, baskets, lights, shelf supports, toilet paper holders, and other wall mounted hardware may be mounted to the wall using the mounting bracket 102. The hardware components may include an attachment portion for mounting the hardware to the mounting bracket 102 where the attachment portion has, for example, a leg and support arm similar to the rod holder 104.

With respect to FIGS. 10-14, a mounting bracket 200 is provided according to another embodiment. The mounting bracket 200 is similar in many respects to the mounting bracket 102 discussed above such that the differences will be highlighted, and the discussion of similar features will not be repeated. The mounting bracket 200 may be used with the rod holder 104 as described above with respect to the mounting bracket 102.

The mounting bracket 200 includes arms 202 that extend from a main body 204. The mounting bracket 200 includes a first set of mounting holes 206 and a second set of mounting holes 208. Each arm 202 includes one of the mounting holes 206 and one of the mounting holes 208. Like the mounting bracket 102 of FIGS. 3-8, the first set of mounting holes 206 extend obliquely to a rear surface 210 of the arms 202 to guide the fasteners into the mounting surface at an oblique angle. With mounting bracket 200, however, the mounting holes 206 are formed in tabs 212 of the arms 202 that extend at an angle from a front surface 214 of the arms 202. For example, the tabs 212 extend at an angle in the range of about 120-140 degrees. In one example, the tabs 212 extend at an approximately 130-degree angle relative to the front surface 214 of the arms 202. The tabs 212 may extend at least partially over openings 216 in the arms 202.

The mounting holes 206 may extend perpendicularly through the tabs 212 such that the holes 206 extends at an oblique angle relative to the arms 202 to guide a fastener extended therethrough at the oblique angle relative to the arms 202. In one example, the holes 206 extend at an approximately 50-degree angle relative to the arms 202 to direct the fastener into the mounting surface at a 50-degree angle. To secure the mounting bracket 200 to a mounting surface, fasteners may be extended through the holes 206 of the tabs 212 and through the openings 216 of the arms 202 into the mounting surface. An edge of the openings 216 may include a lip 218 and/or groove 220 that receive and support the fasteners at the angled orientation as they extend into the mounting surface. Each lip 218 may protrude from the front surface 210 of the arms 202 to aid in guiding the fastener through the openings 216 of the tabs 212 and inhibit the fastener from catching on the front surface 210 of the arm 202 about the opening 216. The groove 220 may extend across an edge of the opening 216 and through the thickness of the arm 202, preferably at the same angle as the hole 206, to further guide the fastener and inhibit it from walking as it is extended into the mounting surface.

In forms where the mounting bracket 200 is metal, the mounting bracket 200 may be formed from sheet metal by cutting, bending, and/or stamping the sheet metal. For example, the outline of the main body 204 and arms 202 may be cut (e.g., with a laser) or stamped from sheet metal. The arms 202 may be bent, for example, by a bending machine. The holes may also be cut or stamped from the main body 204 and arms 202. The tabs 212 may be formed by cutting the portion of the arms 202 about the holes 106 to form the tab 212 and bending the tabs 212 to the desired angle which also forms the openings 216.

Figure 15:
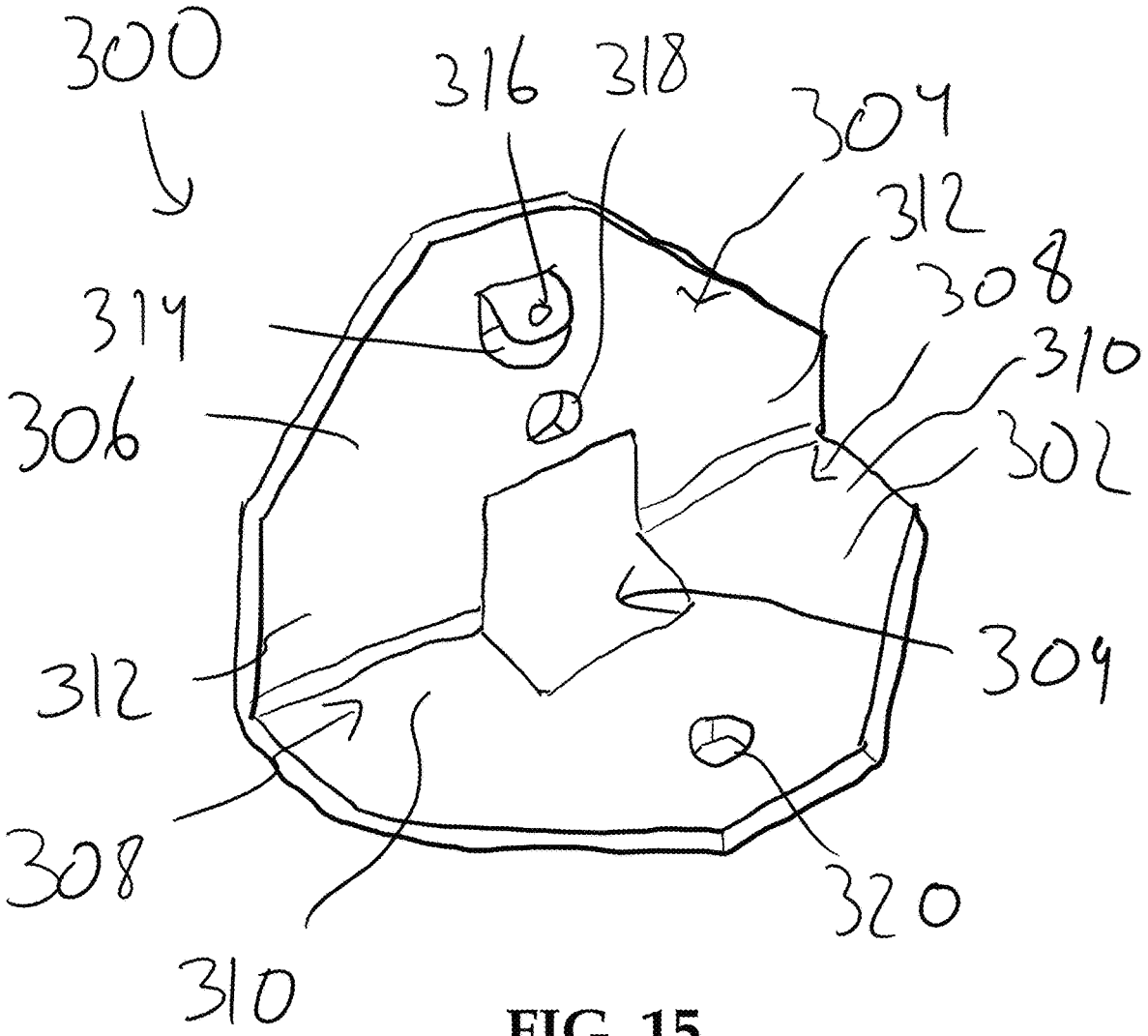
FIG. 15 is a front perspective view of a mounting bracket according to another embodiment.

With respect to FIG. 15, a mounting bracket 300 is provided according to another embodiment. The mounting bracket 300 is similar in many respects to the mounting brackets 102 discussed above such that the differences will be highlighted, and the discussion of similar features will not be repeated. The mounting bracket 300 may be used with the rod holder 104 as described above with respect to the mounting bracket 102.

The mounting bracket 300 differs from the mounting brackets discussed above in that the mounting bracket 300 does not have two arms extending from a supporting portion 302 of the bracket 300. Instead, the mounting bracket 300 includes a mounting portion 304 that has a plate portion 306 and legs 308 extending from the main body 302. The legs 308 of the mounting portion 304 each include a first segment 310 and a second segment 312 that extends at an angle from the first segment 310 to the plate portion 306. The legs 308 are spaced apart from one another forming a gap 309 therebetween that is sized to receive the attachment portion 156 of the rod holder 104 as discussed above.

The plate portion 306 of the mounting portion 304 may include a protrusion 314 extending from the plate portion 306. The protrusion 314 defines a first mounting hole 316 that extends at an oblique angle through the mounting portion 304 as described above to guide a fastener extended therethrough into structure (e.g., a wall) at an oblique angle. In other forms, the plate portion 306 includes a tab that defines the first mounting hole similar to the mounting bracket 200 discussed above. The plate portion 306 may also define a second mounting hole 318 that extends perpendicular to the mounting portion. The first and second mounting holes 316, 318 may be in the center of the mounting bracket 300 and aligned with the gap 309 and a hole 320 of the supporting portion 302. The first mounting hole 316 and/or second mounting hole 318 may be used to mount the mounting bracket 300 to a structure as described above.

In some embodiments, the plate portion 306 includes two or more protrusions each defining first mounting holes 316 that extend at an oblique angle relative to the plate portion 306. The plate portion 306 may additionally or alternatively include two or more second mounting holes 316. Including additional mounting holes may increase the load the mounting bracket 300 is able to support and may also inhibit the mounting bracket 300 from pivoting once mounted.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A bracket comprising:

a mounting bracket having a main body and a first mounting arm and a second mounting arm extending at a non-parallel angle to the main body, the first and second mounting arms defining one or more first mounting holes sized to receive a fastener for affixing the mounting bracket to a structure and disposed at an oblique angle to the first and second mounting arms to direct the fastener into the structure at an oblique angle, the first and second mounting arms spaced by a gap having a first width;

a support arm having a first leg supported on the main body and a second leg extending at an angle to the first leg, the support arm extending through the gap, the support arm having a second width at an interconnection with the mounting bracket at the gap that is less than the first width of the of the gap, the first mounting arm being adjacent one side of the support arm and the second mounting arm being adjacent an opposite side of the support arm; and at least a portion of the one or more first mounting holes being located entirely above the support arm and the main body.

2. The bracket of claim 1 wherein the first and second mounting arms includes one or more protrusions extending therefrom, each of the one or more first mounting holes extending through a protrusion of the one or more protrusions.

3. The bracket of claim 1 wherein one of the first and second mounting arms includes a tab extending obliquely therefrom and an opening, one of the one or more first mounting holes extending through the tab to guide the fastener through the opening.

4. The bracket of claim 3 wherein the one of the first and second mounting arms includes a lip extending along at least a portion of an edge of the opening.

5. The bracket of claim 3 wherein the one of the first and second mounting arms has a groove extending on an edge of the opening through a thickness of the first and second mounting arms.

6. The bracket of claim 5 wherein the groove extends at an oblique angle relative to the one of the first and second mounting arms.

7. The bracket of claim 1 wherein each of the first mounting arm and second mounting arm define one of the one or more first mounting holes.

8. The bracket of claim 1 wherein the first and second mounting arms extend from the main body of the mounting bracket and space at least a portion of the main body of the mounting bracket from the structure.

9. The bracket of claim 1 wherein the first and second mounting arms each include a first surface profiled to engage the structure, and the first and second mounting arms each include a second mounting hole extending substantially perpendicularly to the first surface.

10. The bracket of claim 1 wherein the first and second mounting arms each include a first segment and a second segment, the first segment extending from the main body to the second segment, the second segment extending from the first segment at an angle.

11. The bracket of claim 1 wherein the main body of the mounting bracket engages a bottom surface of the support arm to resist downward deflection of the support arm.

12. The bracket of claim 1 wherein the second leg of the support arm is to be positioned against the structure.

13. The bracket of claim 1 wherein the second leg is at an end of the first leg of the support arm, the second leg sized to be disposed between the structure and the main body to contact the structure.

14. The bracket of claim 1 further comprising a receptacle for supporting a rod at an end of the first leg of the support arm.

15. The bracket of claim 1 wherein the main body includes a hole, and the support arm includes a corresponding hole for securing the support arm to the main body.

* * * * *